United States Patent [19]

Streich

[11] Patent Number: 4,823,881

[45] Date of Patent: Apr. 25, 1989

[54] HYDRAULIC SETTING TOOL

[75] Inventor: Steven G. Streich, Duncan, Okla.

[73] Assignee: Halliburton Company, Duncan, Okla.

[21] Appl. No.: 155,182

[22] Filed: Feb. 11, 1988

[51] Int. Cl.[4] ..... E21B 23/06

[52] U.S. Cl. ..... 166/382; 166/122; 166/131; 166/142; 166/181; 166/386; 166/387

[58] Field of Search ..... 166/120, 122, 123, 131, 166/142, 152, 181, 212, 382, 386, 387, 323, 278

[56] References Cited

U.S. PATENT DOCUMENTS

| | | | |
|---|---|---|---|
| 4,151,875 | 5/1979 | Sullaway | 166/126 |
| 4,185,689 | 1/1980 | Harris | 166/133 |
| 4,253,521 | 3/1981 | Savage | 166/123 |
| 4,427,063 | 1/1984 | Skinner | 166/134 |
| 4,436,149 | 3/1984 | Edwards | 166/120 |
| 4,441,552 | 4/1984 | Hamman | 166/133 |
| 4,516,634 | 5/1985 | Pitts | 166/120 |
| 4,583,593 | 4/1986 | Zunkel et al. | 166/382 |
| 4,590,995 | 5/1986 | Evans | 166/127 |
| 4,606,408 | 8/1986 | Zunkel et al. | 166/278 |
| 4,627,488 | 12/1986 | Szarka | 166/278 X |
| 4,646,829 | 3/1987 | Barrington et al. | 166/125 |
| 4,649,995 | 3/1987 | Read | 166/115 |
| 4,665,992 | 5/1987 | Franc | 166/387 |
| 4,687,063 | 8/1987 | Gilbert | 166/382 |
| 4,708,208 | 11/1987 | Halbardier | 166/387 |

OTHER PUBLICATIONS

Halliburton Services Sales & Service Catalog No. 43, pp. 2556–2557 and 2561–2562.

*Primary Examiner*—Bruce M. Kisliuk

*Attorney, Agent, or Firm*—James R. Duzan; Neal R. Kennedy

[57] ABSTRACT

A hydraulic setting tool for packers. The setting tool comprises a case with a ball valve therein, a bypass passageway for bypassing around the ball valve when the ball valve is in a closed position, a fill valve for closing the bypass passageway when desired, and a packer setting sleeve for hydraulically setting a packer attached below the setting tool. The fill valve is preferably characterized by a sliding sleeve valve annularly disposed on a stationary mandrel in the case and is movable in response to a pressure in the tool. The packer setting sleeve is attached to a setting piston which may be actuated in response to a first differential pressure between the tool string and a well annulus. A slidable mandrel is provided in operative association with the ball valve and is movable in response to a second differential pressure between the well annulus and the tool string. The second differential pressure also acts to raise the setting piston and setting sleeve to a retracted position spaced away from the packer. A method of positioning and setting a packer using the setting tool is also disclosed.

20 Claims, 4 Drawing Sheets

HYDRAULIC SETTING TOOL

BACKGROUND OF THE INVENTION

1. Field of the Invention

This invention relates to setting tools of packers, and more particularly, to a setting tool which is hydraulically actuated and has a built-in fill valve.

2. Description of the Prior Art

In the drilling or reworking of oil wells it is often desirable to seal between one oil well flow conductor, such as tubing or other pipe, and another flow conductor, such as the well casing in which the tubing is telescoped. Such a seal is generally provided by a packer.

One particular type of packer which is known to the prior art is a squeeze packer. A squeeze packer includes a mandrel having upper and lower slip assemblies connected thereto with expandable packer elements located between the slip assemblies. A tension sleeve is threadedly engaged with an upper end of the packer mandrel. The packer includes a valve means such as an internal sliding sleeve located within a bore of the packer mandrel.

Such a squeeze packer has previously been actuated by a tool known as a setting tool. Some setting tools of the prior art operate purely mechanically and include a stinger means or lower mandrel for engagement with the sliding valve sleeve, a tubular setting sleeve for engagement with the upper slip assembly of the packer to set the upper slip assembly, drag springs connected to the setting sleeve, and a screw jack means for producing axial motion of the setting sleeve relative to the stinger means when a drill string to which the setting tool is attached is rotated. Prior art setting tools have also included threaded connections to the tension sleeve of the packer. Squeeze packers are operated by the setting tools in the following manner.

A setting tool is made up to the end of a tool string. The packer is threadedly connected to the setting tool. Then, the tool string, setting tool and packer are run into the oil well casing until the desired location of the packer is reached.

The tool string is then rotated a predetermined number of revolutions, thereby moving the setting sleeve downwardly relative to the stinger means so that the setting sleeve engages the upper slip assembly of the packer to set the upper slip assembly against the inner bore of the casing.

After the upper slip assembly is set, the drill string is pulled upwardly to expand the packer elements and to set the lower slip assembly. After the lower slip assembly is set, the tension sleeve is further loaded and tensioned until it parts, thereby separating the setting tool from the packer. The setting tool is then set back down until the setting sleeve once again engages the upper slip assembly and the tubing is pressure-tested.

After the pressure-testing, the setting tool is lifted up until the stinger means is pulled out of engagement with the packer. The tool string is then rotated through a second predetermined number of revolutions to actuate a means for releasing the setting sleeve so that the setting sleeve is free to move in an axial direction relative to the stinger means.

The drill string is once again set down to engage the stinger means with the sliding valve sleeve of the packer to move the sliding valve sleeve downward to open the packer valve.

Using some of the apparatus of the prior art, the entire load set down on the packer is transmitted to the sliding valve sleeve by the stinger means. The sliding valve sleeve in turn transmits that load to a point near the lower end of the packer mandrel.

The packer mandrel itself is supported from the well casing through the upper slip assembly. Therefore, a portion of the packer mandrel, located between the upper slip assembly and the point of support of the valve sleeve, is put in tension. In squeeze packers of this type, the mandrel is generally manufactured from cast iron, and the load-carrying capabilities of cast iron in tension are very much inferior to the load-carrying capabilities of cast iron in compression. The tension loads which can be carried by the cast iron packer mandrel are on the order of 20,000 to 30,000 pounds. In a very deep oil well, having a depth of greater than 10,000 feet, it is very difficult to accurately control the amount of weight which is set down on the packer when actuating the valve sleeve. It often happens with these prior setting tools that an excess amount of weight is set down on the packer causing the packer mandrel to fail due to the excess tension loading.

One apparatus that solves this problem is disclosed in U.S. Pat. No. 4,253,521 to Savage, assigned to the assignee of the present invention. The Savage apparatus provides a setting tool which engages the packer in such a manner that the weight of the drill string is carried by the packer mandrel in compression rather than in tension. A resilient spring means is provided such that the downward force applied to the lower mandrel of the packer must be transmitted through the resilient spring means. The maximum downward force which can be applied to the lower mandrel, and correspondingly to the sliding sleeve of the packer, is equal to a force required to fully compress the resilient spring means. The Savage apparatus also includes an improved releasable locking means between an upper mandrel and a sleeve assembly in the setting tool so that the sleeve assembly may be released to allow free rotational and axial motion of the upper mandrel relative to the sleeve assembly.

The prior art apparatus of Savage is particularly well adapted for setting Halliburton EZ Drill® squeeze packers, and particularly the Halliburton EZ Drill SV® squeeze packer with pressure balanced sliding valve therein which is shown in the Savage patent. These packers are illustrated in the Halliburton Services Sales and Service Catalog No. 43, pages 2561–2562. The EZ Drill® packer is also disclosed in U.S. Pat. No. 4,151,875 to Sullaway, assigned to the assignee of the present invention. The setting tool of Savage works well with these packers, but the setting operation requires rotation of the drill string. Such drill string rotation is not as easily carried out in some conditions, such as when horizontal drilling is being done. In horizontal drilling, it is more difficult to rotate the drill string. Therefore, it is desirable to have a setting tool which is hydraulically rather than mechanically actuated.

A hydraulically activated liner setting device is disclosed in U.S. Pat. No. 4,583,593 to Zunkel et al., also assigned to the assignee of the present invention. This hydraulic device provides for setting a packer by response to differential pressure between the tubing and the well annulus. The Zunkel apparatus includes a ball valve which is closed as the apparatus is run into the hole. Therefore, a fill-up valve means of a type known in the art is positioned above the setting tool in the drill string to allow the tool string to fill. One problem with this apparatus is that it is relatively long and this makes it less well adapted for horizontal drilling conditions. The present invention which includes a flow valve means in a closed position as the apparatus is run into the hole has a built-in fill valve means which internally bypasses the flow valve means. The fill valve means is actuated in response to pressure in the setting tool. The present invention provides a much more compact setting tool than the apparatus of Zunkel, and thus the present invention is particularly well adapted for horizontal drilling conditions.

The Zunkel apparatus also may require dropping a ball down the drill string to the tool under some circumstances. Other known setting tools also involve the use of a ball or a plug which must be inserted in the tool string at the surface. The ball or plug falls to a seat in the setting tool, and pressure is then applied inside the tool string to set the packer. However, dropping balls does no always work satisfactorily in horizontal drilling applications. The present invention does not require the dropping of balls or plugs which is another feature which makes it well suited for horizontal drilling.

Another method of setting packers involves the use of electric wire line in a powder-type setting tool. An electrical charge generated through the line detonates a black powder charge in the setting tool which sets the packer. Wire line setting tools are also not well adapted to horizontal drilling conditions, and thus the present invention provides an improvement over such devices.

SUMMARY OF THE INVENTION

The hydraulic setting tool of the present invention may be described as a packer setting apparatus comprising case means for attaching to a tool string positionable in a well bore, flow passageway means in the case means for providing fluid communication between the tool string and a packer, flow valve means in the case means for controlling flow of fluid through the flow passageway means, bypass passageway means in the case means for providing a fluid bypass around the flow valve means, fill valve means for closing the bypass means, and packer setting means in the case means for setting the packer in the well bore. The flow valve means is responsive to one differential pressure between a well annulus and the flow passageway means. The fill valve means is responsive to a pressure in the bypass passageway means. The packer setting means is responsive to another differential pressure between the flow passageway means and the well annulus.

The packer setting apparatus may further comprise mandrel means slidably disposed in the case means and in operative association with the flow valve means for moving the flow valve means to an open position. Preferably, the apparatus also comprises locking means for locking the flow valve means in the open position and for locking the fill valve means in a closed position.

The packer setting means may be retracted in response to the one differential pressure between the well annulus and the flow passageway means, and the apparatus may further comprise locking means for locking the packer setting means in a retracted position.

Shear means may be provided for holding the fill valve means in an open position prior to applying the pressure in the bypass passageway means, for holding the flow valve means in a closed position prior to applying the one differential pressure, and for holding the packer setting means in an intermediate position prior to applying the other differential pressure.

The slidable mandrel means is disposed on one side of the flow valve means and preferably defines a transverse port therein, and the apparatus may further comprise stationary mandrel means disposed on an opposite side of the flow valve means from the slidable mandrel means. The stationary mandrel means also defines a transverse port therein, and the bypass passageway means may be at least partially characterized by the ports and an annular passageway between the flow valve means and the case means.

One preferred embodiment of the packer setting means may be said to comprise an elongated case attachable at an upper end thereof to a tool string, a stationary mandrel defining a longitudinal passageway therethrough and disposed in a lower portion of the case, a slidable mandrel defining a longitudinal passageway therethrough and disposed in an upper portion of the case, a ball valve disposed between the stationary and slidable mandrels and sized such that an annular passageway is formed between the case and an outer surface of the ball valve, a fill valve means disposed on the stationary mandrel, and packer setting means disposed in the case and extending from a lower end thereof. The stationary mandrel comprises an upper portion defining a first port therethrough and a stinger portion extending downwardly from the case for engagement with a central portion of the packer. The slidable mandrel comprises a lower portion defining a second port therethrough. The annular passageway between the ball valve and case is in communication with the first and second ports, and the ball valve is movable from a closed position to an open position in response to movement of the slidable mandrel for allowing fluid communication between the longitudinal passageway in the stationary mandrel and the longitudinal passageway in the slidable mandrel.

In this embodiment, the fill valve means is movable from an open position to a closed position thereof covering the first port in response to a predetermined pressure in the setting tool, the packer setting means is movable from an intermediate position to a lower position thereof for setting the packer in response to a first differential pressure between the longitudinal passageway in the slidable mandrel and the well annulus, and the ball valve is movable from the closed position to the open position thereof and the packer setting means is movable from the lower position to an upper position thereof in response to a second differential pressure between the well annulus and the longitudinal passageway in the slidable mandrel.

Also in this preferred embodiment, the fill valve means is characterized by an annular sleeve disposed around a portion of the stationary mandrel. A pair of diameters on the stationary mandrel define a first annular area on the sleeve valve on which the predetermined pressure in the setting tool acts.

In the preferred embodiment, the packer setting means comprises a setting piston slidably disposed in an annular space between a portion of the case and a portion of the stationary mandrel, and a setting sleeve attached to the setting piston and extending downwardly therefrom. A diameter on the case and a diameter on the stationary mandrel define a second annular area on the setting piston on which the first differential pressure acts, and a diameter on the case and a diameter on the slidable mandrel define a third annular area on the slidable mandrel on which the second differential pressure acts. The case defines a transverse port therethrough providing communication between the third annular area and the well annulus.

Also in the preferred embodiment, the setting tool may further comprise a coupling ring on the stationary mandrel adapted for connection to a tension sleeve on the packer. The coupling ring is preferably rotatable with respect to the stationary mandrel.

The invention further includes a setting of positioning and setting a packer on a tool string in a well bore comprising the steps of running the tool string into the well bore while internally bypassing fluid around a flow valve in a setting tool adjacent the packer, positioning the packer at a desired location in the well bore, providing pressure in the setting tool and well bore for closing a fill valve in the setting tool, pressurizing the tool string above the pressure in the well annulus for actuating a setting piston and thereby at least partially setting the packer into engagement with the well bore, and pressurizing the well annulus above a pressure in the tool string for opening the flow valve. In one embodiment, the step of pressurizing the well annulus further raises the setting piston to a retracted position. The method also preferably comprises locking the setting piston in the retracted position, locking the fill valve in the closed position, and locking the flow valve in the open position. The method may also comprise shearing means during at least one of the pressurizing steps.

Another step in the method comprises pumping cement downwardly through the tool string through the open flow valve for cementing a portion of the well annulus below the packer.

An important object of the present invention is to provide a setting tool for packers which is hydraulically actuated and requires no rotation of the tool string or dropping of balls or plugs through the tool string.

Another object of the invention is to provide a compact hydraulic setting tool outside for use in horizontal drilling applications.

A further object of the invention is to provide a hydraulic packer setting apparatus with internal bypass means bypassing around a closed flow valve means therein.

Still another object of the invention is to provide a hydraulic setting tool in which packer setting means may be locked in a position spaced from the packer after setting the packer.

An additional object of the invention is to provide an improved method of positioning and setting a packer in a well bore.

Additional objects and advantages of the invention will become apparent as the following detailed description of the preferred embodiment is read in conjunction with the drawings which illustrate such preferred embodiment.

DESCRIPTION OF THE PREFERRED EMBODIMENT

Figure 1:
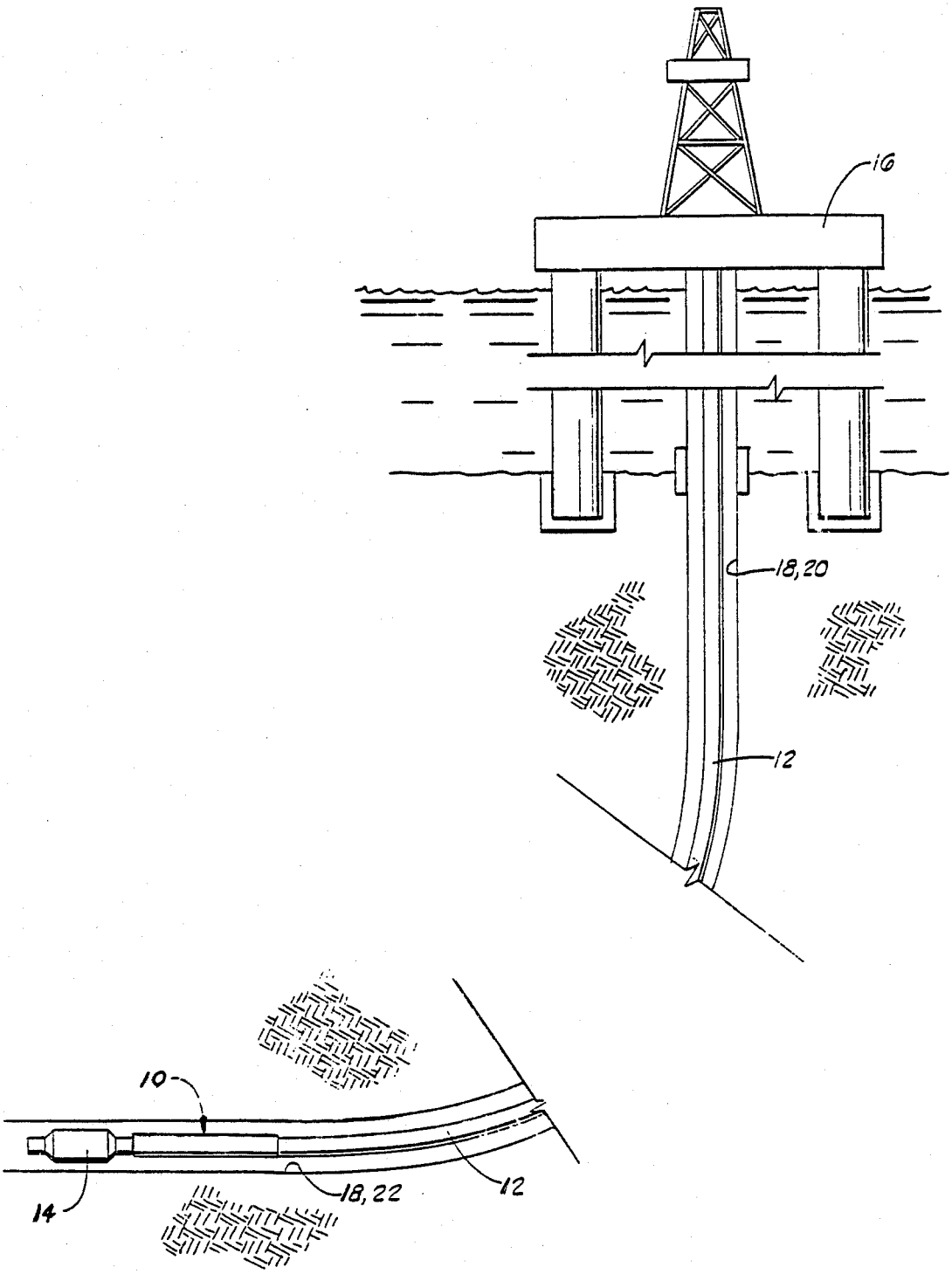
FIG. 1 illustrates the hydraulic setting tool of the present invention and a packer at the end of a tool string in a horizontal drilling application.

Referring now to the drawings, and more particularly to FIG. 1, the hydraulic setting tool of the present invention is shown and generally designated by the numeral 10. Setting tool 10 is attached at a first end thereof to a tool or tubing string 12. Attached to an opposite, second end of setting tool 10 is a packer 14. Packer 14 is of a kind known in the art such as the Halliburton EZ Drill SV® squeeze packer with pressure-balanced sliding valve, disclosed in Hilliburton Services Sales and Service Catalog No. 43, pages 2561–2562 and U.S. Pat. No. 4,253,521 to Savage, copies of which are incorporated herein by reference.

As seen in FIG. 1, tool string 12 extends downwardly from an offshore platform 16 into a well bore 18. Platform 16 is of a kind known in the art and is used for illustration purposes only. Setting tool 10 is equally applicable to land based operations. FIG. 1 illustrates a "horizontal drilling" operation in which well bore 18 has a substantially vertically oriented portion 20 and a substantially horizontal portion 22 further downhole from the vertical portion. This type of well bore is known in the art so FIG. 1 has been truncated to show vertical and horizontal portions 20 and 22, and details of the drilling process are omitted. Even though there is a horizontal portion 22, the direction from setting tool 10 to tool string 12 is designated as "up".

Referring now to FIGS. 2A–2E, details of setting tool 10 will be discussed.

Figure 2A:
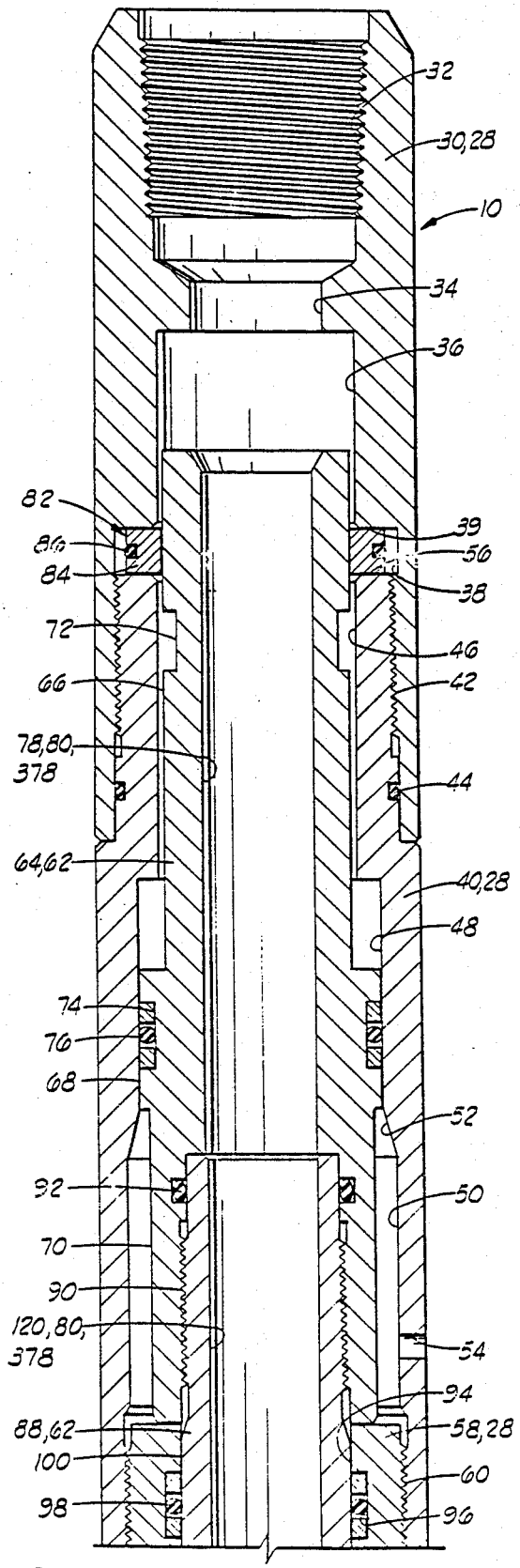
FIGS. 2A–2E show a partial cross section of the hydraulic setting tool.

As shown in FIG. 2A, setting tool 10 includes a case means 28 comprising at a first, upper end thereof an upper adapter 30 having an internally threaded portion 32 which provides a means for connecting to tool string 12. Upper adapter 30 has a first bore 34, a second bore 36, and a counterbore 18. A downwardly facing, annular shoulder 39 interconnects second bore 36 and counterbore 38 of upper adapter 30. The lower end of upper adapter 30 is attached to upper case 40 at threaded connection 42. Upper case 40 thus forms the next component of case means 28. Sealing means, such as O-ring 44, provides sealing engagement between upper adapter 30 and upper case 40.

Upper case 40 has a first bore 46, a second bore 48, and a third bore 50. A tapered, annular surface 52 interconnects second bore 48 and third bore 50. At least one radial hole 54 extends through upper case 40 and is in communication with third bore 50.

It will be seen that top end 56 of upper case 40 faces, and is spaced from, shoulder 39 in upper adapter 30. The lower end of upper case 40 is attached to the upper end of a shear pin adapter 58 at threaded connection 60. It also will be seen that shear pin adapter 58 also forms a portion of case means 28.

Disposed in case means 28 is an upper, slidable mandrel means 62. Forming the upper end of slidable mandrel means 62 is a locking sleeve 64. Locking sleeve 64 is generally disposed in upper case 40 and has a portion extending into upper adapter 30. Locking sleeve 64 has a first outside diameter 66, a larger second diameter 68, and a third outside diameter 70.

An annular locking groove 72 is disposed in first outside diameter 66 of locking sleeve 64. A seal groove 74 is disposed in second outside diameter 68. A seal means 76 of a kind known in the art is disposed in seal groove 74 and provides sealing engagement between locking sleeve 64 and second bore 48 of upper case 40.

Locking sleeve 64 defines an inner bore 78 therethrough. Inner bore 78 may be said to form a portion of a longitudinal flow passageway means 80 which extends through the entire length of setting tool 10.

A locking means 82 is disposed in the annular volume defined in counterbore 38 of upper adapter 30 and between shoulder 39 in the upper adapter and top end 56 of upper case 40. In the preferred embodiment, locking means 82 comprises a plurality, such as three, arcuate locking dogs 84 which are biased inwardly by biasing means 86. Biasing means 86 may comprise an O-ring, a garter spring, or other means known in the art. Biasing means 86 thus urges locking dogs 84 against first outside diameter 66 of locking sleeve 64. Locking means 82 is adapted for engaging locking groove 72 when slidable mandrel means 62 is moved upwardly, as will be discussed in more detail herein.

The locking end of locking sleeve 64 is attached to upper seat holder 88 at threaded connection 90. It will be seen that upper seat holder 88 forms another portion of slidable mandrel means 62. Sealing means, such as O-ring 92, provides sealing engagement between locking sleeve 64 and upper seat holder 88.

Still referring to FIG. 2A, shear pin adapter 58 has a first bore 94 with an annular seal groove 96 extending radially outwardly therefrom. A sealing means 98 is disposed in groove 96 for providing sealing engagement between shear pin adapter 58 and a first outside diameter 100 of upper seat holder 88.

Figure 2B:
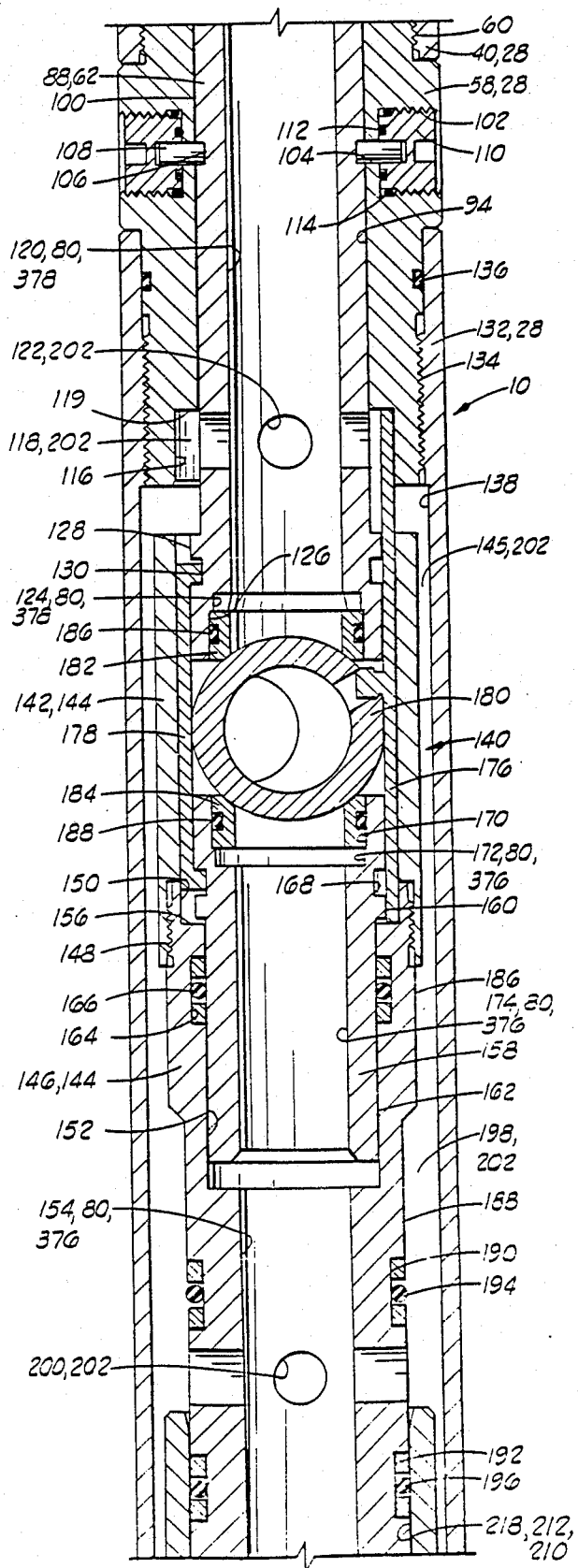
Figure 1:
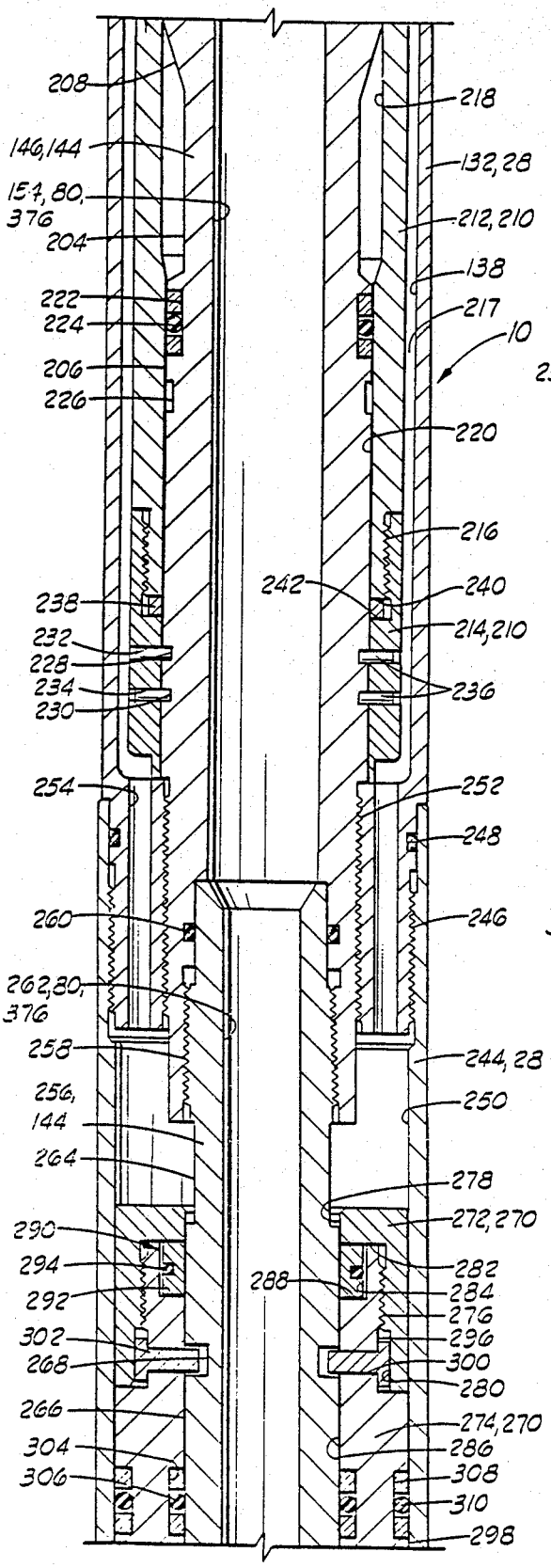
Figure 2:
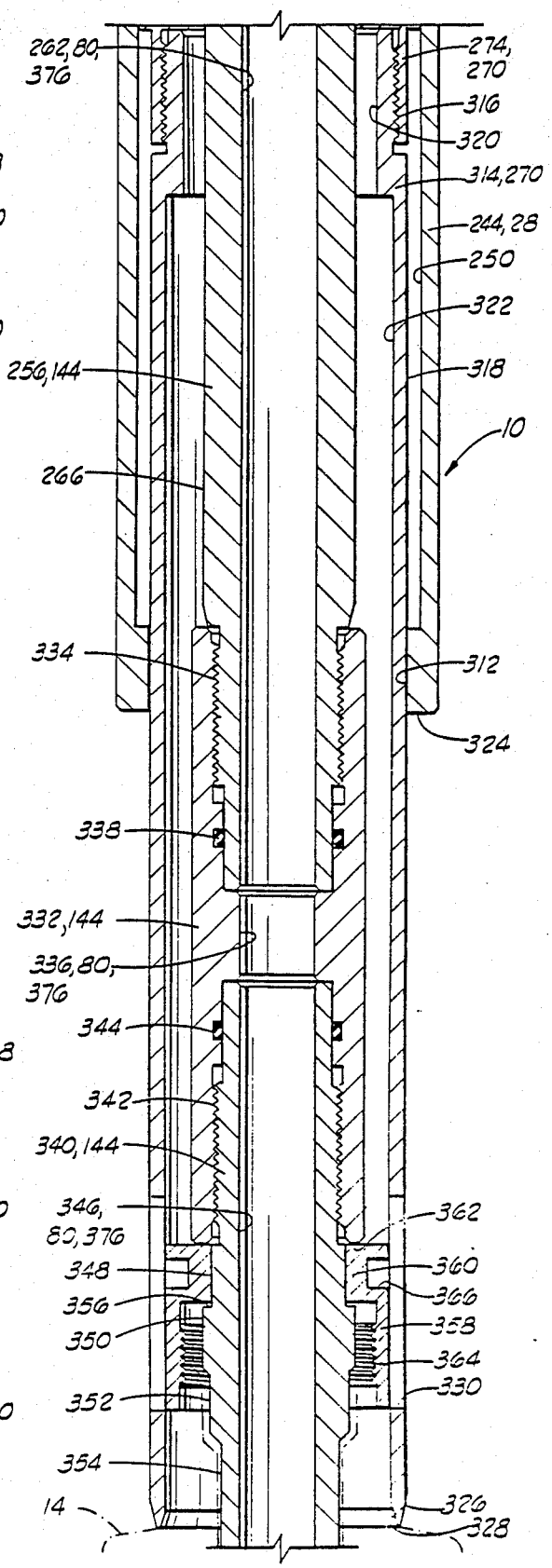

Referring now to FIG. 2B, shear pin adapter 58 defines at least one radially oriented threaded opening 102 therein. Preferably, there are a plurality of such threaded openings 102. A relatively smaller opening 104 extends between threaded opening 102 and first bore 94 of shear pin adapter 58. Preferably, opening 104 is substantially concentric with threaded opening 102.

An annular groove 106 extends radially inwardly from outside diameter 100 on upper seat holder 88. In the position shown in FIG. 2B, groove 106 is substantially aligned with openings 104 in shear pin adapter 58.

A shear pin 108 is disposed through each opening 104 such that it extends into and engages groove 106. A shear pin nut 110 is threadingly engaged with each threaded opening 102 and provides a means for holding each shear pin 108 in the position shown in FIG. 2B. Sealing means, such as O-rings 112 and 114, provide sealing engagement between each shear pin nut 110 and shear pin adapter 58.

Shear pin adapter 58 has a second bore 116 at the lower end thereof which is larger than first bore 94 thereof. It will thus be seen that second bore 116 provides a portion of a boundary for an annular space 118 between shear pin adapter 58 and upper seat holder 88. A downwardly facing, annular shoulder 119 extends between first bore 94 and second bore 116 of shear pin adapter 58, and shoulder 119 also provides a portion of the boundary for annular space 118.

Upper seat holder 88 defines a longitudinally extending first bore 120 therethrough which is substantially aligned with inner bore 78 of locking sleeve 64, as best seen in FIG. 2A, and thus inner bore 120 forms also a portion of longitudinal passageway means 80. Referring again to FIG. 2B, upper seat holder 88 defines a plurality of radially oriented upper ports 122 therethrough which provide communication between longitudinal passageway means 80 and annular space 118.

Upper seat holder 88 also defines second bore 124 and third bore 126 near the lower end thereof. Also at the lower end of upper seat holder 88 is a second outside diameter 128 with an annular groove 130 extending radially inwardly therefrom.

The lower end of shear pin adapter 58 is connected to a center case 132 at threaded connection 34. It will be seen that center case 132 also forms a portion of case means 28. A sealing means, such as O-ring 136, provides sealing engagement between shear pin adapter 58 and center case 132. Center case 132 defines a first bore 138 therein.

Disposed substantially within center case 132 is a flow valve means 140. In the embodiment shown in FIG. 2B, flow valve means 140 comprises a ball valve assembly which will be referred to herein as ball valve 140. However, the invention is not intended to be limited specifically to a ball valve arrangement, and other types of valve construction may also be used.

Ball valve 140 is of a kind generally known in the art and includes a cage sleeve 142. As will be more clearly seen herein, cage sleeve 142 forms the upper portion of a lower, stationary mandrel means 144 which is fixed in relationship to case means 28. Cage sleeve 142 is spaced inwardly from first bore 138 of center case 132 sko that an annular passageway 145 is defined therebetween.

The lower end of cage sleeve 142 is attached to inner mandrel 146 at threaded connection 148.

Inner mandrel 146 forms another portion of stationary mandrel means 144 and defines a first bore 150, a second bore 152 and a third bore 154. As will be seen, third bore 154 forms a portion of longitudinal passageway means 80. An upwardly facing, annular shoulder 156 extends between first bore 150 and second bore 152. It will be seen that shoulder 156 generally faces shoulder 119 in shear pin adapter 58.

A lower seat holder 158 is slidably disposed in inner mandrel 146 and extends partially into cage sleeve 142. Lower seat holder 158 has a first outside diameter 160 and a second outside diameter 162. A seal groove 164 extends radially outwardly from second bore 152 of inner mandrel 146, and a sealing means 166 is disposed in groove 164 for providing sealing engagement between inner mandrel 146 and second outside diameter 162 of lower seat holder 158. First outside diameter 160 of lower seat holder 158 has a radially inwardly extending groove 168 therein.

Lower seat holder 158 further defines a first bore 170, a second bore 172, and a third bore 174 therein. It will be seen that second bore 172 and third bore 174 form a portion of longitudinal passageway means 80 through setting tool 10.

Disposed between shoulder 119 in shear pin adapter 58 and shoulder 156 in inner mandrel 146, and longitudinally fixed thereby, is an operating arm 176 of ball valve 140. At least one C-clamp 178 is longitudinally positioned in cage sleeve 142 and has upper and lower portions which engage groove 130 in upper seat holder 88 and groove 168 in lower seat holder 158. Thus, upper seat holder 88 and lower seat holder 158 are substantially fixed longitudinally with respect to one another.

The remaining components of ball valve 140 include ball 180, upper seat 182 and lower seat 184, all of a kind known in the art. A sealing means, such as O-ring 186, provides sealing engagement between upper seat 182 and third bore 126 of upper seat holder 88. Similarly, a sealing means, such as O-ring 188, provides sealing engagement between lower seat 184 and first bore 170 of lower seat holder 158. Operating arm 176 engages ball 180 in a manner also known in the art. When ball 180 is in the position shown in FIG. 2B, it closes off longitudinal passageway means 80. Ball valve 140 is initially held in this position by shear pins 108 as setting tool 10 is run into well bore 18.

It will be seen by those skilled in the art that C-clamp 178, lower seat holder 158, upper seat 182, ball 180, and lower seat 184 are free to move longitudinally with upper seat holder 88 of slidably mandrel means 62, and thus, these movable components of ball valve 140 may also be generally described as part of slidable mandrel means 62.

Inner mandrel 146 has a first outside diameter 186 and a second outside diameter 188. An upper annular seal groove 190 extends radially inwardly from second outside diameter 188 of inner mandrel 146. Spaced below upper seal groove 190 is a substantially similar lower annular seal groove 192 which also extends radially inwardly from second outside diameter 188 of inner mandrel 146. Sealing means 194 and 196 of a kind known in the art are disposed in upper seal groove 190 and lower seal groove 192, respectively.

It will be seen that an annular passageway 198 is formed between inner mandrel 146 and center case 132 and is in communication with annular passageway 145. A plurality of lower ports 200 extend radially through inner mandrel 146 and are positioned longitudinally between sealing means 194 and 196. It will be clear to those skilled in the art that when the components of setting tool 10 are in the positions shown in FIG. 2B that upper ports 122, annular space 118, annular passageway 145, annular passageway 198 and lower ports 200 provide fluid communication between the portions of longitudinal passageway means 80 above and below ball 180, even though ball 180 is in a closed position, and thus generally characterize one embodiment of a bypass passageway means 202.

Referring now also to FIG. 2C, inner mandrel 146 has a third outside diameter 204 and a fourth outside diameter 206. An annular, tapered shoulder 208 extends between second outside diameter 188 and third outside diameter 204.

A fill valve means 210 is provided for closing lower ports 200 in inner mandrel 146 and thus closing bypass passageway means 202. In the preferred embodiment, fill valve means 210 is characterized by a closing sleeve 212 disposed annularly around inner mandrel 146. The lower end of closing sleeve 212 is connected to a shear pin sleeve 214 at threaded connection 216. Fill valve means 210 is spaced inwardly from first bore 138 of center case 132 so that an annular passageway 217 is defined therebetween.

Closing sleeve 212 defines a first bore 218 and a second bore 220 therethrough. Sealing means 196 provides sealing engagement between inner mandrel 146 and first bore 218 of closing sleeve 212, as best seen in FIG. 2B.

Referring again to FIG. 2C, a seal groove 222 extends radially inwardly from fourth outside diameter 206 of inner mandrel 146. A sealing means 224 is disposed in groove 222 and provides sealing engagement between inner mandrel 146 and second bore 220 of closing sleeve 212.

Also defined in fourth outside diameter 206 of inner mandrel 146 are a locking groove 226 adjacent seal groove 222 and a pair of spaced shear pin grooves 228 and 230 adjacent shear pin sleeve 214. At least one radially oriented shear pin hole 232 is disposed through shear pin sleeve 214 in alignment with shear pin groove 228. Similarly, at least one shear pin hole 234 is disposed radially through shear pin sleeve 214 in alignment with shear pin groove 230. A plurality of such holes 232 and 234 may be angularly spaced around shear pin sleeve 214. A shear pin 236 is disposed in each of holes 232 and 234 and positioned such that the shear pin extends into the corresponding shear pin groove 228 or 230. Thus, a means is provided for holding fill valve means 210 in the open position shown in FIGS. 2B and 2C.

An annular valve lock ring 238 is disposed between bottom end 240 of closing sleeve 212 and upwardly facing shoulder 242 of shear pin sleeve 214. Lock ring 238 is of a kind known in the art, such as a retainer ring, with an inwardly directed bias. As will be discussed in more detail hereinafter, valve lock ring 238 is adapted for engagement with locking groove 226 on inner mandrel 146, thus providing a locking means for locking fill valve means 210 in a closed position.

The lower outside portion of center case 132 is attached to lower case 244 at threaded connection 246. It will be seen that lower case 244 forms a portion of case means 28. Sealing means, such as O-ring 248, provides sealing engagement between center case 132 and lower case 244. Lower case 244 defines a first bore 250 therein.

The lower inside portion of center case 132 is attached to the lower outside portion of inner mandrel 146 at threaded connection 252. It will be seen by those skilled in the art that stationary mandrel means 144 is thus fixed in relationship to case means 28.

A plurality of angularly spaced holes 254 extend longitudinally through the lower portion of center case 132 and provide fluid communication between annular passageway 217 and the interior of lower case 244.

The lower inside portion of inner mandrel 146 is attached to a lower mandrel 256 at threaded connection 258. A sealing means, such as O-ring 260, provides sealing engagement between inner mandrel 146 and lower mandrel 256.

Lower mandrel 256 forms a portion of stationary mandrel means 144 and defines an inner bore 262 therein which is in communication with third bore 154 of inner mandrel 146. Inner bore 262 thus forms another portion of longitudinal passageway means 80. Lower mandrel 256 has a first outside diameter 264 and a larger second outside diameter 266. As will be discussed in more detail herein, first outside diameter 264 forms a locking groove on lower mandrel 256. Extending radially inwardly from second outside diameter 266 is at least one shear pin hole 268.

A packer setting means, generally designated by the numeral 270, is annularly and slidably disposed between case means 28 and stationary mandrel means 144. An upper end of packer setting means 270 includes a shear pin cap 272 which is connected to a setting piston 274 at threaded connection 276. Shear pin cap 272 has a first bore 278 and a second bore 280. Extending radially outwardly from first bore 278 is a downwardly facing annular shoulder 282.

Setting piston 274 has a first bore 284 and a second bore 286 therein. An annular, upwardly facing shoulder 288 extends between first and second bores 284 and 286. Thus, an annular cavity is defined by shoulder 282 in shear pin cap 272, first bore 284 and shoulder 288 in setting piston 274, and second outside diameter 266 of lower mandrel 256. Disposed in this cavity is a locking means 290 which is adapted for engagement with the locking groove formed by first outside diameter 264 of lower mandrel 256 in a manner hereinafter described in more detail. Locking means 290 is similar to locking means 82 in that locking means 290 also comprises a plurality of arcuate locking dogs 292 biased inwardly by a biasing means 294.

Setting piston 274 has a first outside diameter 296 and a second outside diameter 298. Extending radially through setting piston 274 are a plurality of shear pin holes 300 which are aligned with shear pin hole 268 in lower mandrel 256. A shear pin 302 extends through each shear pin hole 300 and into groove 268 to provide a means for initially holding packer setting means 270 in a fixed relationship with stationary mandrel means 144 and case means 28.

Setting piston 274 has a real groove 304 therein extending radially outwardly from second bore 286, and a sealing means 306 is disposed in groove 304 for providing sealing engagement between setting piston 274 and second outside diameter 266 of lower mandrel 256. Setting piston 274 also defines a real groove 308 extending radially inwardly from second outside diameter 298, and a sealing means 310 is disposed in groove 308 for providing sealing engagement between setting piston 274 and first bore 250 of lower case 244.

Referring now to FIG. 2D, it wll be seen that lower case 244 forms a lowermost end of case means 28 and defines a second bore 312 therein which is somewhat smaller than first bore 250.

A lower end of setting piston 274 is connected to the upper end of a setting sleeve 314 at threaded connection 316. Setting sleeve 314 has an outside diameter 318 in close, spaced relationship to second bore 312 of lower case 244. Setting sleeve 314 defines a first bore 320 and a somewhat larger second bore 322 therethrough. It will be seen that setting sleeve 314 forms a portion of packer setting means 270 and extends downwardly from lower end 324 of lower case 244. Setting sleeve 314 has an outer, downwardly facing chamfer 326 and an inner, downwardly facing chamber 328. A plurality of transverse openings 330 extend through setting sleeve 314 at a location between lower end 324 of lower case 244 and chamfers 326 and 328.

The lower end of lower mandrel 256 is attached to a stinger adapter 332 at threaded connection 334. It will be seen that stinger adapter 332 forms another portion of stationary mandrel means 144, and a central bore 336 in stinger adapter 332 forms another portion of longitudinal passageway means 80. A sealing means, such as O-ring 338, provides sealing engagement between lower mandrel 256 and stinger adapter 332.

The lower end of stinger adapter 332 is attached to a stinger means for engaging a central bore of packer 14. In the embodiment shown in FIGS. 2D and 2E, the stinger means is characterized by an elongated stinger 340. Stinger adapter 332 is attached to stinger 340 at threaded connection 342. A sealing means, such as O-ring 344, provides sealing engagement between stinger adapter 332 and stinger 340. It will be seen that stinger 340 thus forms the lowermost portion of stationary mandrel means 144, and an inner bore 346 of the stinger forms the lower portion of longitudinal passageway means 80. Stinger 340 extends downwardly below setting sleeve 314 and into packer 14 in a manner substantially identical to the stinger in the setting tool disclosed in U.S. Pat. No. 4,253,521 to Savage, previously discussed.

Stinger 340 has a first outside diameter 348, a second outside diameter 350, a third outside diameter 352 and a fourth outside diameter 354. An annular, upwardly facing shoulder 356 extends between first and second outside diameters 348 and 350.

A coupling ring 358 has an inwardly directed portion 360 disposed between lower end 362 of stinger adapter 332 and shoulder 356 on stinger 340. Coupling ring 358 has a lower, interior threaded portion which is adapted for threading engagement with a tension sleeve of packer 14. To facilitate connection of coupling ring 358 to packer 14, a plurality of wrench openings 366 are provided in the outer surface of coupling ring 358. Wrench openings 366 are accessed through openings 330 in setting sleeve 314.

Figure 2E:
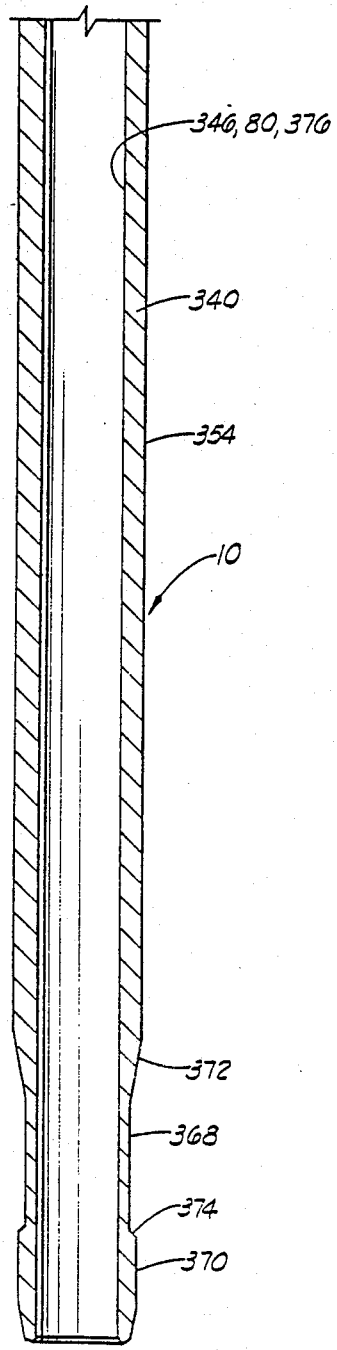

Referring now to FIG. 2E, the remaining portion of stinger 340 is shown. It will be seen that stinger 340 has a fifth outside diameter 368 and a sixth outside diameter 370. In the illustrated embodiment, a tapered, annular surface 372 interconnects fourth and fifth outside diameters 354 and 368, and another shoulder 374 interconnects fifth and sixth outside diameters 368 and 370. This lower end of stinger 340 is adapted for connection with a sliding valve in some configurations of packer 14, such as the Halliburton EZ Drill SV® squeeze packer.

Operation Of The Invention

The tool is made up by connecting upper adapter 30 of case means 28 of setting tool 10 to the lower end of tool string 12. Packer 14 is positioned at the lower end of setting tool 10 with a tension sleeve on the packer threadedly engaged by coupling ring 358. The lower end of setting sleeve 314 is adjacent an upwardly facing portion of packer 14 as seen in FIG. 2D. Stinger 340 extends down through a central bore of packer 14 and is adapted for engaging a sliding valve sleeve therein. Packer 14 is preferably a Halliburton EZ Drill SV® squeeze packer, as already discussed. However, setting tool 10 is also adapted for use with the Halliburton EZ Drill® squeeze packer with spring-loaded back pressure valve or the EZ Disposal TM packer. Setting tool 10 could also be adapted for similar squeeze packers.

Once tool string 12 is made up with setting tool 10 and packer 14, the string may be lowered into well bore 18. Fluid enters the tool string in a manner known in the art through an opening in a lower portion of packer 14 which is in fluid communication with a lower portion 376 of flow passageway means 80. Lower portion 376 is defined as that portion of flow passageway means 80 below flow valve means 140.

Because flow valve means 140 is in a closed position as tool string 12 is lowered into well bore 18, fluid will flow from lower portion 376 of longitudinal passageway means 80 around flow valve means 140 through bypass passageway means 202 and then into upper portion 378 of longitudinal passageway means 80. Upper portion 378 of longitudinal passageway means 80 is defined as that portion of the passageway means above flow valve means 140. That is, fluid will flow upwardly through lower portion 376, through lower ports 200 in inner mandrel 140, through annular passageways 198 and 145, through annular space 118 and into lower portion 378 through upper ports 122. The fluid then flows upwardly with respect to tool string 12 through upper portion 378 of longitudinal passageway means 80. Thus, setting tool 10 allows filling of tool string 12 which facilitates lowering of the tool string into well bore 18.

Once packer 14 is positioned in the desired location in well bore 18, fill valve means 210 must be closed before the packer can be set. This is accomplished by providing pressure to tool string 12 and the well annulus. This may be accomplished by using the hydrostatic pressure in that location in well bore 18 or by pressuring tool string 12 and the well annulus from the surface. It will be seen by those skilled in the art that the pressure acts upwardly on fill valve means 210. The pressure acts on a first annular area defined by a transverse cross-sectional area of first bore 218 of closing sleeve 12 minus a transverse cross-sectional area of second bore 220 of closing sleeve 212. The pressure is selected to be sufficient to shear shear pins 236, thus allowing fill valve means 210 to move upwardly with respect to inner mandrel 146, as best seen in FIGS. 2B and 2C. Closing sleeve 212 is moved sufficiently upwardly such that first bore 218 thereof is in sealing engagement with sealing means 194, thus closing lower ports 200. Upward movement of fill valve means 210 ceases when inwardly biased valve lock ring 238 engages locking groove 226 on inner mandrel 146, thus locking fill valve means 210 in a position closing bypass passageway means 202.

The next step is to raise the pressure in tool string 12 above that in the well annulus. It will be seen that this raises the pressure above packer setting means 270. That is, the pressure in upper portion 378 of longitudinal passageway means 80 is the same as the pressure immediately above packer setting means 270, because the packer setting means is in communication with upper portion 378 of the longitudinal passageway means through upper ports 122, annular space 118, annular passageways 145, 198 and 217, and longitudinal holes 254. Thus, a differential pressure between tool string 12 and the well annulus acts downwardly on packer setting means 270. This differential pressure is exerted on a second annular area defined by a transverse cross-sectional area of first bore 250 of lower case 244 minus a transverse cross-sectional area of second outside diameter 266 of lower mandrel 256. This first differential pressure is sufficient to shear shear pins 302 and thus move packer setting means 270 downwardly with respect to stationary mandrel means 144. That is, setting sleeve 314 is moved downwardly with respect to stinger 340. This relative downward motion of setting sleeve 340 acts to set packer 14.

Pressure is then relieved in tool string 14 and pressure applied to the well annulus. Referring now to FIG. 2A, it will be seen that annulus pressure is applied in an annular volume defined between third bore 50 of upper case 40 and third outside diameter 70 of locking sleeve 64 through hole 54. Thus, a differential pressure between the well annulus and tool string 12 is exerted upwardly on slidable mandrel means 62. That is, this second differential pressure acts upwardly on a third annular area defined by a transverse cross-sectional area of second bore 48 of upper case 40 minus a transverse cross-sectional area of first outside diameter 100 of upper seat holder 88. The force exerted by the second differential pressure is sufficient to shear shear pins 108, thus allowing slidable mandrel means 62 to move upwardly and thus open ball valve 140. The actuation of the ball valve mechanism itself is known in the art. As slidable mandrel means 62 moves upwardly, inwardly biased locking means 82 engages locking groove 72 in locking sleeve 64. In this manner, flow valve means 140 is locked in an open position.

When the well annulus pressure is raised to move slidable mandrel means 62 and actuate flow valve means 140, it will be seen that the differential pressure also acts upwardly on the second annular area on packer setting means 270, forcing the packer setting means away from packer 14. Packer setting means 270 is thus moved upwardly until inwardly biased locking means 290 engages the locking groove formed by first outside diameter 264 of lower mandrel 256. Thus, packer setting means 270 is locked upwardly away from packer 14 when flow valve mean 140 is opened. This prevents later pressurization in tool string 12 from acting downwardly on packer setting means 270 which could raise setting tool 110 away from packer 14.

Once flow valve means 140 is opened, a squeeze cementing operation may be carried out in a conventional manner. Normally, during the packer setting operation, the packer tension sleeve parts, but if this does not occur, tool string 12 may be lifted to assist in parting the tension sleeve. After the cementing operation, tool string 12 and setting tool 10 may be removed from well bore 18 so that further operations on the well may be carried out in a manner known in the art.

It can be seen, therefore, that the hydraulic setting tool of the present invention is well adapted to carry out the ends and advantages mentioned, as well as those inherent therein. While a presently preferred embodiment of the apparatus and the method of operation is described for the purposes of this disclosure, numerous changes in the arrangement and construction of parts and in the method of operation may be made by those skilled in the art. All such changes are encompassed within the scope and spirit of the appended claims.

What is claimed is:

1. A packer setting apparatus comprising:

case means for attaching to a tool string positionable in a well bore;

flow passageway means in said case means for providing fluid communication between said tool string and a packer;

flow valve means in said case means for controlling flow of fluid through said flow passageway means, said flow valve means being reponsive to one differential pressure between a well annulus and said flow passageway means;

bypass passageway means in said case means for providing a fluid bypass within said case means around said flow valve means;

fill valve means for closing said bypass passageway means in response to a pressure in said bypass passageway means acting on an area defined on said fill valve means; and packer setting means in said case means for setting said packer in said well bore in response to another differential pressure between said flow passageway means and said well annulus.

2. The apparatus of claim 1 further comprising mandrel means slidably disposed in said case means and in operative association with said flow valve means for moving said flow valve means to an open position.

3. The apparatus of claim 2 further comprising locking means for locking said flow valve means in said open position.

4. The apparatus of claim 1 further comprising locking means for ceasing movement of said fill valve means and locking said fill valve means in a closed position.

5. The apparatus of claim 1 further comprising shear means for holding said fill valve means in an open position prior to providing said pressure in said bypass passageway means.

6. A packer setting apparatus comprising:

case means for attaching to a tool string positionable in a well bore;

flow passageway means in said case means for providing fluid communication between said tool string and a packer;

flow valve means in said case means for controlling flow of fluid through said flow passageway means, said flow valve means being responsive to one differential pressure between a well annulus and said flow passageway means;

bypass passageway means in said case means for providing a fluid bypass around said flow valve means;

fill valve means for closing said bypass passageway means in response to a pressure in said bypass passageway means;

packer setting means in said case means for setting said packer in said well bore in response to another differential pressure between said flow passageway means and said well annulus; and means for retracting said packer setting means with respect to said case means in response to said one differential pressure between said well annulus and said flow passageway means after setting of said packer.

7. The apparatus of claim 6 further comprising locking means for locking said packer setting means in a retracted position.

8. A packer setting apparatus comprising:

case means for attaching to a tool string positionable in a well bore and defining a longitudinal axis therethrough;

flow passageway means in said case means for providing fluid communication between said tool string and a packer;

flow valve means in said case means for controlling flow of fluid through said flow passageway means, said flow valve means being responsive to one differential pressure between a well annulus and said flow passageway means;

slidable mandrel means disposed on one side longitudinally of said flow valve means in operative association therewith, said slidable mandrel means defining a portion therein extending substantially transversely with respect to said longitudinal axis;

stationary mandrel means disposed on an opposite side longitudinally of said flow valve means from said slidable mandrel means, said stationary mandrel means defining a port therein extending substantially transversely with respect to said longitudinal axis;

bypass passageway means in said case means for providing a fluid bypass around said flow valve means, said bypass passageway means being at least partially characterized by said ports and an annular passageway between said flow valve means and said case means;

fill valve means for closing said bypass passageway means in response to a pressure in said bypass passageway means; and packer setting means in said case means for setting said packer in said well bore in response to another differential pressure between said flow passageway means and said well annulus.

9. A packer setting tool for use with a squeeze packer, said setting tool comprising:

an elongated case attachable at an upper end thereof to a tool string;

a stationary mandrel defining a longitudinal passageway therethrough and disposed in a lower portion of said case, said stationary mandrel comprising:

an upper portion defining a first port therethrough; and a stinger portion extending downwardly from said case for engagement with a central portion of said packer;

a slidable mandrel defining a longitudinal passageway therethrough and disposed in an upper portion of said case, said slidable mandrel comprising a lower portion defining a second port therethrough;

a ball valve disposed between said stationary and slidable mandrels, said ball valve being sized such that an annular passageway is formed between said case and an outer surface of said ball valve, said annular passageway being in communication with said first and second ports, and said ball valve being movable from a closed position to an open position in response to movement of said slidable mandrel for allowing fluid communication between said longitudinal passageway in said stationary mandrel and said longitudinal passageway in said slidable mandrel;

a fill valve means disposed on said stationary mandrel and movable from an open position to a closed position covering said first port; and packer setting means disposed in said case and extending from a lower end thereof, said packer setting means being movable from an intermediate position to a lower position for setting said packer and further movable from said lower position to an upper position spaced from said packer;

wherein:

said fill valve means is movable from said open position to said closed position thereof in response to a predetermined pressure in said setting tool;

said packer setting means is movable from said intermediate position to said lower position thereof for setting said packer in response to a first differential pressure between said longitudinal passageway in said slidable mandrel and said well annulus; and said ball valve is movable from said closed position to said open position thereof and said packer setting means is movable from said lower position to said upper position thereof in response to a second differential pressure between said well annulus and said longitudinal passageway in said slidable mandrel.

10. The setting tool of claim 9 wherein said fill valve means is characterized by an annular sleeve disposed around a portion of said stationary mandrel.

11. The setting tool of claim 10 wherein a pair of diameters on said stationary mandrel define a first annular area on said sleeve valve on which said predetermined pressure in said setting tool acts.

12. The apparatus of claim 9 wherein said packer setting means comprises:

a setting piston slidably disposed in an annular space between a portion of said case and a portion of said stationary mandrel; and a setting sleeve attached to said setting piston and extending downwardly therefrom.

13. The apparatus of claim 12 wherein a diameter on said case and a diameter on said stationary mandrel define a second annular area on said setting piston on which said first differential pressure acts.

14. The setting tool of claim 9 wherein a diameter on said case and a diameter on said slidable mandrel define a third annular area on said slidable mandrel on which said second differential pressure acts.

15. The setting tool of claim 9 further comprising locking means for locking said fill valve means in said closed position, locking means for locking said packer setting means in said upper position, and locking means for locking said ball valve means in said open position after actuation thereof.

16. Th setting tool of claim 9 further comprising a coupling ring on said stationary mandrel adapted for connection to a tension sleeve on said packer.

17. A method of positioning and setting a packer on a tool string in a well bore, said method comprising the steps of:

running said tool string into said well bore while internally bypassing fluid in a setting tool adjacent said packer around a flow valve disposed in said setting tool;

positioning said packer at a desired location in said well bore;

providing pressure in said setting tool and well bore for acting on an area defined on a fill valve in said setting tool for closing said fill valve;

pressurizing said tool string above the pressure in said well annulus for actuating a setting piston and thereby at least partially setting said packer into engagement with said well bore; and pressurizing said well annulus above a pressure in said tool string for opening said flow valve.

18. The method of claim 17 further comprising:

ceasing movement of said fill valve and locking said fill valve in said closed position; and locking said flow valve in said open position.

19. A method of positioning and setting a packer on a tool string in a well bore, said method comprising the steps of:

running said tool string into said well bore while internally bypassing fluid around a flow valve in a setting tool adjacent said packer;

positioning said packer in a desired location in said well bore;

providing pressure in said setting tool and well bore for closing a fill valve in said setting tool;

pressurizing said tool string above the pressure in said well annulus for actuating a setting piston and thereby at least partially setting said packer into engagement with said well bore; and pressurizing said well annulus above a pressure in said tool string for opening said flow valve and raising said setting piston to a retracted position with respect to said tool string.

20. The method of claim 19 further comprising locking said setting piston in said retracted position.

* * * * *

UNITED STATES PATENT AND TRADEMARK OFFICE

CERTIFICATE OF CORRECTION

PATENT NO. : 4,823,881

DATED : April 25, 1989

INVENTOR(S) : Steven G. Streich

It is certified that error appears in the above-identified patent and that said Letters Patent is hereby corrected as shown below:

In column 3, line 20, delete [no] and insert therefore --not--.

In column 5, line 10, delete [setting] and insert therefore --method--.

In column 17, line 9, delete [Th] and insert therefore --The--.

Signed and Sealed this

Third Day of April, 1990

*Attest:*

HARRY F. MANBECK, JR.

*Attesting Officer*

*Commissioner of Patents and Trademarks*